US006668557B2

(12) United States Patent
Ohta et al.

(10) Patent No.: US 6,668,557 B2
(45) Date of Patent: Dec. 30, 2003

(54) PILOT NOZZLE OF GAS TURBINE COMBUSTOR

(75) Inventors: Masataka Ohta, Hyogo (JP); Kuniaki Aoyama, Hyogo (JP); Mitsuru Inada, Hyogo (JP); Shigemi Mandai, Hyogo (JP); Satoshi Tanimura, Hyogo (JP); Katsunori Tanaka, Hyogo (JP); Koichi Nishida, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/200,165

(22) Filed: Jul. 23, 2002

(65) Prior Publication Data

US 2003/0019213 A1 Jan. 30, 2003

(30) Foreign Application Priority Data

Jul. 24, 2001 (JP) ..... 2001-223208

(51) Int. Cl.[7] ..... F02C 7/264; F02C 1/00

(52) U.S. Cl. ..... 60/740; 60/749; 60/39.826

(58) Field of Search ..... 60/39.463, 39.465, 60/740, 749, 750, 39.826

(56) References Cited

U.S. PATENT DOCUMENTS

| | | | | | |
|---|---|---|---|---|---|
| 4,821,512 | A | * | 4/1989 | Guile et al. | 60/768 |
| 5,836,163 | A | * | 11/1998 | Lockyer et al. | 60/737 |
| 5,857,339 | A | * | 1/1999 | Roquemore et al. | 60/749 |
| 6,199,368 | B1 | * | 3/2001 | Onoda et al. | 60/39.463 |
| 6,434,945 | B1 | * | 8/2002 | Mandai et al. | 60/740 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

A pilot nozzle of a gas turbine combustor comprises a first structure, provided near a main nozzle of a combustor that injects fuel oil, having a flow channel for a fuel gas and an outlet for the fuel gas. The first structure diffusion-injecting the fuel gas obliquely forward through the outlet to maintain a flame and to aid ignition of the fuel oil injected from the main nozzle. There is further provided a second structure which circulates in whirls a combustion gas generated due to the combustion of the fuel gas.

10 Claims, 8 Drawing Sheets

PILOT NOZZLE OF GAS TURBINE COMBUSTOR

FIELD OF THE INVENTION

This invention relates to the pilot nozzle of the gas turbine combustor intended to improve flame stabilization. The invention further relates to the pilot nozzle of the gas turbine combustor that improves flame stabilization by using the circulation of the combustion gas arising from combustion in the gas turbine combustor.

BACKGROUND OF THE INVENTION

FIG. 8 shows a cross section of a pilot nozzle 83 of a conventional gas turbine combustor. The pilot nozzle 83 is a dual type that injects two types of fuels, namely, fuel oil 81 and fuel gas 82. The fuel oil 81 flows along the longitudinal axis ("oil-flow channel") of the pilot nozzle 83 and is diffusion-injected from the tip of the pilot nozzle 83. On the other hand, the fuel gas 82 flows through a plurality of fuel-flow channels 84 and is diffusion-injected obliquely forward relative to the pilot nozzle 83. The fuel-flow channels 84 are laid longitudinally at, say, eight locations along the outer circumferential periphery of the pilot nozzle 83. Peripherally to the pilot nozzle 83 flows in spirals the pilot air that has passed through the pilot swirler 85, the swirling air then in a mixture with the fuel gas producing a spurt of pilot flame.

The conventional pilot nozzle 83 has a drawback that the fuel consumption is rather high, and there is a demand for curbing the fuel consumption. The combustion of fuel oil from the main nozzle constitutes the main combustion in the combustion chamber, because of which the curbing of the use of fuel oil injected from the main nozzle is in no sense appropriate. On the other hand, the flame of fuel gas 82 injected from the pilot nozzle 83 is functionally meant to just aid in the ignition of fuel oil injected from the main nozzle. It is this very function of fuel gas 82 that renders it possible for fuel consumption to be curbed without impairing the role of the pilot nozzle 83, if and only if flame stabilization can be improved nonetheless.

SUMMARY OF THE INVENTION

It is an object of this invention to provide a pilot nozzle of the gas turbine combustor that utilizes circulation of the combustion gas arising from the combustion taking place in the combustor and improves flame stabilization.

The pilot nozzle of a gas turbine combustor according to one aspect of the present invention comprises a first structure, near a main nozzle of a combustor that injects fuel oil, having a flow channel for a fuel gas and an outlet for the fuel gas, the first structure diffusion-injecting the fuel gas obliquely forward through the outlet to maintain a flame and to aid ignition of the fuel oil injected from the main nozzle, and a second structure which circulates in whirls a combustion gas generated due to the combustion of the fuel gas.

The pilot nozzle of the gas turbine combustor according to another aspect of the present invention comprises a central axis, a flow channel for a fuel gas, the flow channel being parallel to the central axis, and an outlet for injecting the fuel gas and aiding ignition of the fuel oil injected from the main nozzle. A portion of the flow channel in the vicinity of the outlet is bent towards the central axis.

Other objects and features of this invention will become apparent from the following description with reference to the accompanying drawings.

DETAILED DESCRIPTIONS

Embodiments of the gas turbine combustor and of the pilot nozzle according to this invention will be explained in detail below with reference made to the accompanying drawings.

Figure 1A:
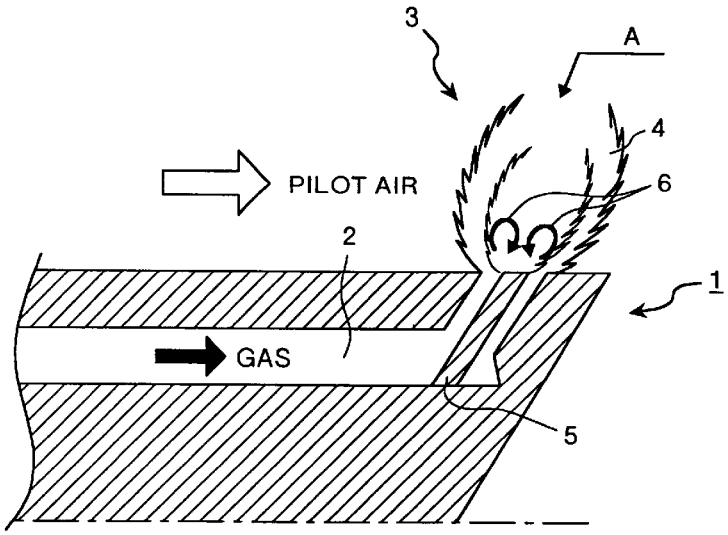
FIG. 1A through FIG. 1D are cross-sections of a portion of a pilot nozzle according to the first embodiment of the present invention.
Figure 1B:
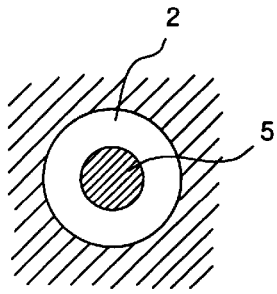
Figure 1C:
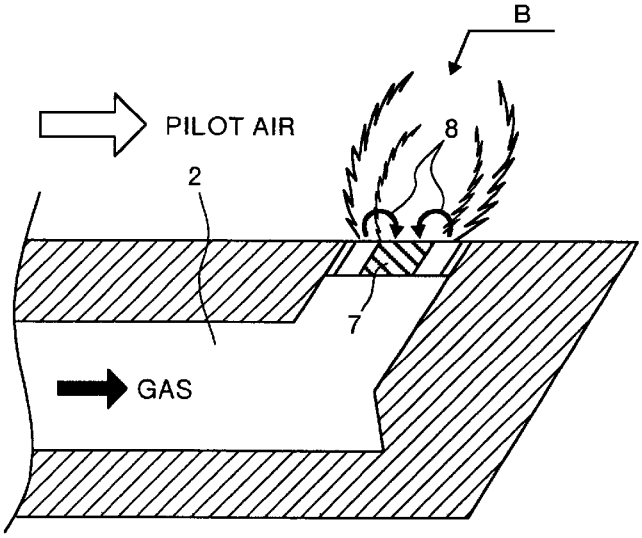

FIG. 1A and FIG. 1C show cross-sections of a portion of a tip of the pilot nozzle of the gas turbine combustor according to a first embodiment of this invention. FIG. 1A shows a cylindrical flow dividing body 5 as it is set at the injecting port outlet, the portion corresponding to the flame root. FIG. 1C shows a disk (circular plate) 7 as it is set central to the injection port outlet. In FIG. 1A, pilot air flows downstream surrounding a pilot nozzle 1. A fuel-flow channel 2 is disposed inside the pilot nozzle 1. The fuel-flow channel 2 is parallel to the axis of the pilot nozzle 1 and bent outward at the tip 3.

The pilot nozzle 1 diffusion-injects fuel gas-obliquely forward to form flame 4. FIG. 1B shows a view from the direction of an arrow A. As is clear from FIG. 1B, the fuel gas injection port outlet has the cylindrical flow dividing body 5 installed in the center. The combustion gas that accompanies the combustion of fuel gas circulates in whirls in the direction of the arrows 6 at the outlet of the fuel gas injection port, the circulation being induced by the flow of fuel gas that jets out as if to avoid the flow dividing body 5. This stabilizes the flame 4 at the root of the flame and prevents the flame being blown off in a swift flow of air from upstream.

Figure 1D:
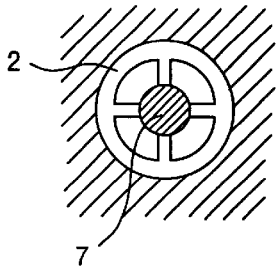

FIG. 1C shows a case in which instead of the cylindrical flow dividing body 5 a flow dividing body 7 having a disk shape at the center is fitted to the outlet of the fuel gas injection port. FIG. 1D shows a view from the direction of an arrow B. As is clear from FIG. 1D, the disk in the center of the flow dividing body 7 is supported on four sides by a ring fitted to the fuel gas injection port outlet. Because of this, fuel gas flows as if to avoid the centrally set disk and the combustion gas that accompanies a fuel gas combustion at the injection port outlet begins to circulate in the direction of the arrows 8. The flow dividing body 7 may well come in an elliptically cylindrical or prismatic shape also. Provision of the flow dividing body 7 in any shape thus improves the stability of the flame that occurs at the pilot nozzle. The flame stability thus improved is a substantial contribution to fuel economy.

According to the first embodiment, the fuel gas injected from the pilot nozzle reacts with air to form a flame, around which then forms combustion gas accompanying the combustion. As this combustion gas circulates around the fuel injection port outlet, namely the portion where the root of pilot flame occurs, the pilot flame gets stabilized since the flame is protected by the circulating gas from being blown off in a rapid stream of pilot air from upstream.

Figure 2A:
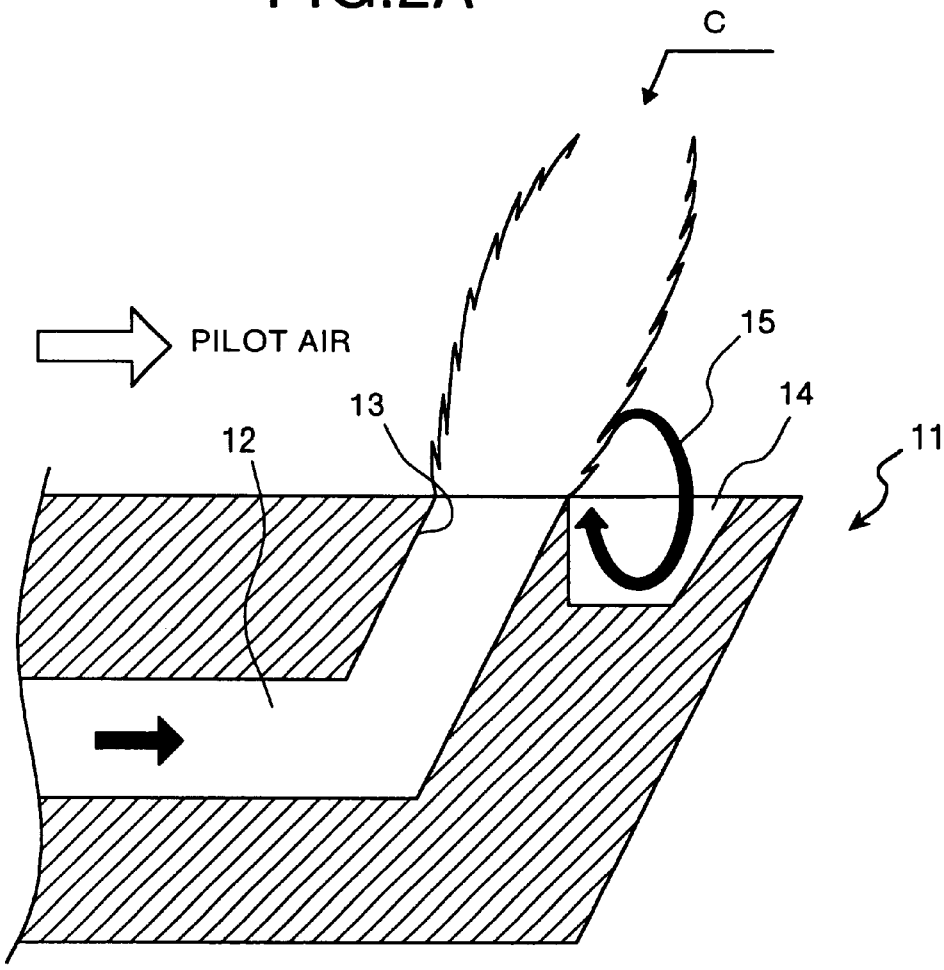
FIG. 2A and FIG. 2B are cross-sections of a portion of a pilot nozzle according to the second embodiment of the present invention.
Figure 2B:
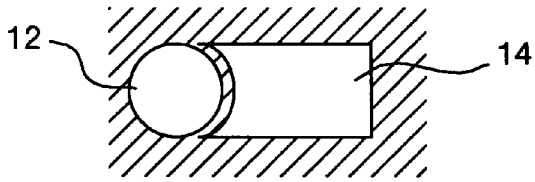

FIG. 2A shows a cross-section of a portion of a pilot nozzle 11 of the gas turbine combustor according to a second embodiment of this invention. The pilot air that surrounds the pilot nozzle 11 and a fuel-flow channel 12 are the same as the pilot nozzle 1 and the fuel-flow channel 2 in the first embodiment, so they are not explained but omitted. The pilot nozzle 11 has a cavity 14 provided on the downstream side of the fuel gas injection port 13, a downstream side, that is, relative to the flow of pilot air. FIG. 2B shows a view from the direction of an arrow C. As is clear from FIG. 2B, the cavity 14 is formed of a hollow partly provided on the downstream side of the fuel gas injection port 13.

Combustion gas arises around a flame at the pilot nozzle. In the presence of the cavity 14 near the root of the flame, the combustion gas flows into, and circulates in, the cavity 14 in the direction of the arrow 15. The whirls that the circulation produces stabilize the root of the flame and help prevent the flame from being blown off in a stream of air from upstream. The cavity 14 is easily worked by cutting or by electric discharge machining. The cavity, therefore, may not necessarily limit itself to the shape, size, or depth illustrated but may well choose any forms or dimensions that may facilitate the circulation of combustion gas. As the flame stability is improved, so also is fuel economy since the combustion of fuel oil from the main nozzle can be aided with a smaller input of fuel gas than in the conventional practices.

Figure 3A:
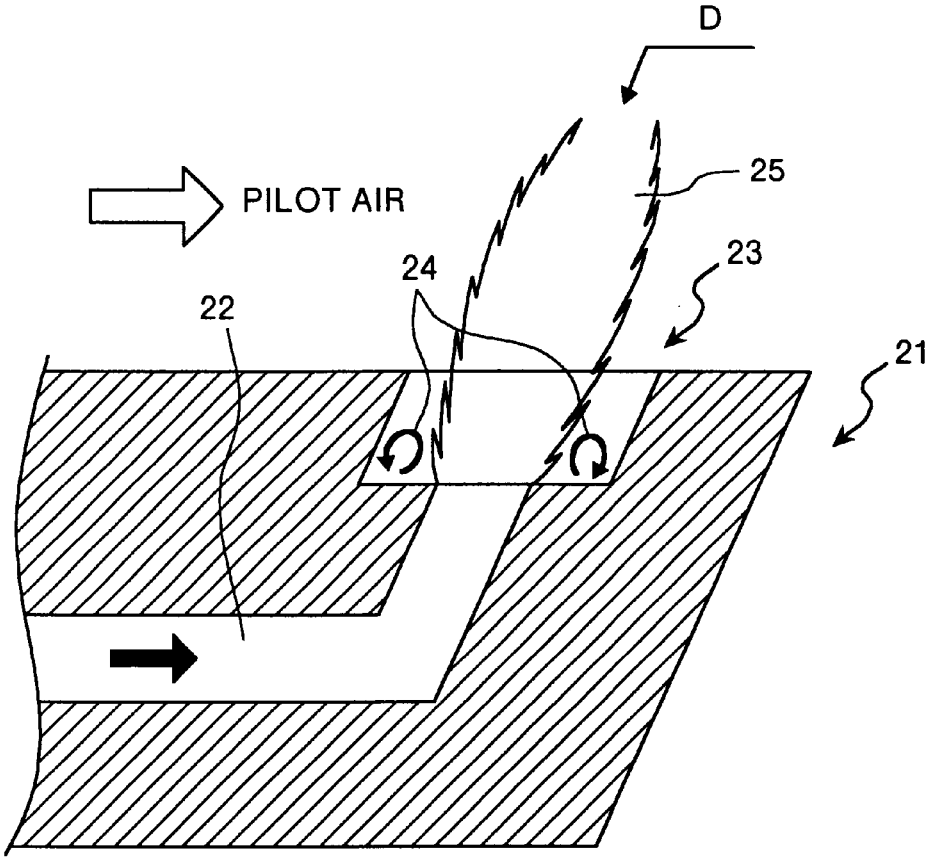
FIG. 3A and FIG. 3B are cross-sections of a portion of a pilot nozzle according to the third embodiment of the present invention.
Figure 3B:
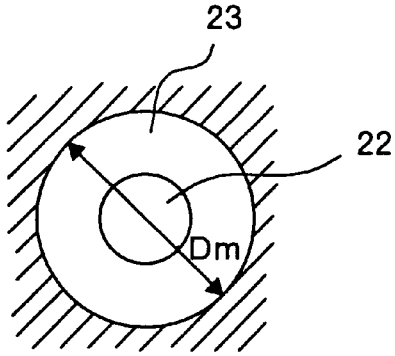

FIG. 3A shows a cross-section of a portion of a pilot nozzle 21 of the gas turbine combustor according to a third embodiment of this invention. FIG. 3B shows a view from the direction of an arrow D. The pilot nozzle 21 is characterized such that the bore Dm of a fuel-flow channel 22, at the fuel gas injection port outlet 23, has been expanded in a counter boring fashion. When the fuel-flow channel bore is drastically expanded at the injection port outlet 23, the combustion gas that accompanies the combustion of fuel gas circulates in the directions of the arrows 24. The whirls that the circulation produces surround the flame root and prevent the flame from being blown off in a stream of air from upstream. In expanding the channel bore, a choice is made of sizes or depths suitable enough to facilitate the circulation of combustion gas.

Such a structure related to the fuel-flow channel bore not only facilitates the working or machining involved. It also makes easy the formation of whirls in which combustion gas circulates. The structure further precludes the chance of pilot air blowing direct onto the root of the flame. This improves the flame stability of a diffusive flame 25 arising at the pilot nozzle 21. As the flame stability improves, so also does fuel oil economy.

Figure 4A:
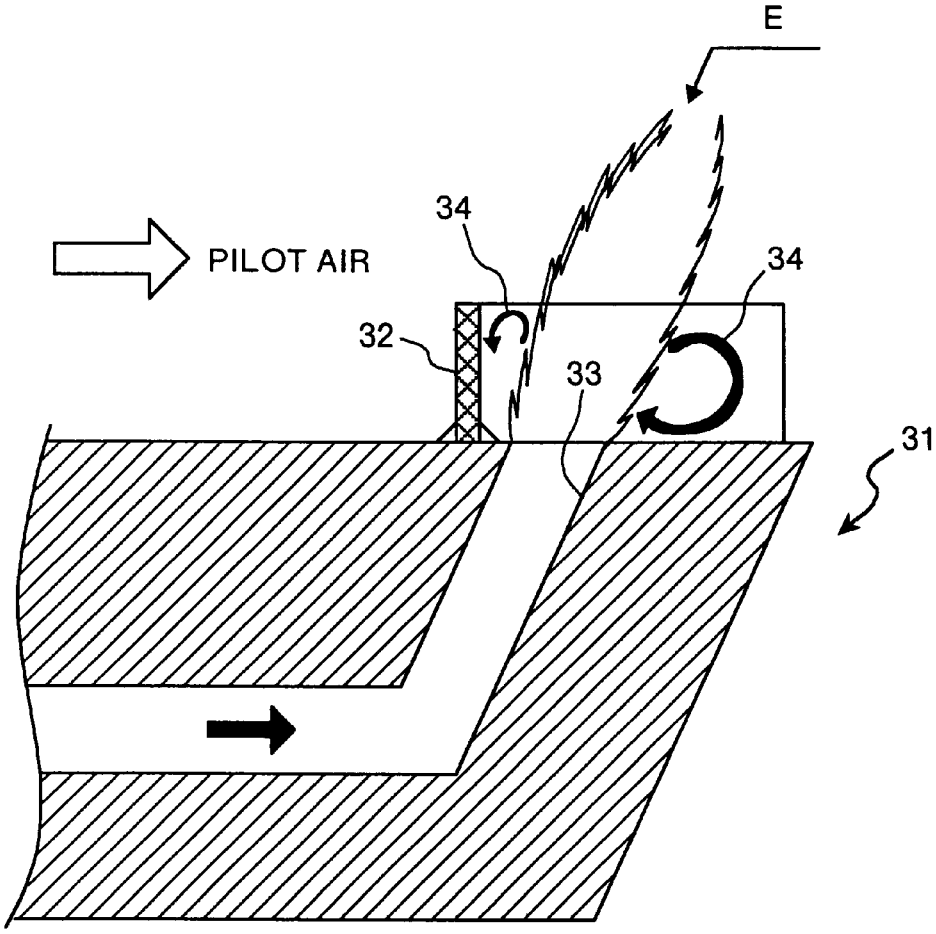
FIG. 4A and FIG. 4B are cross-sections of a portion of a pilot nozzle according to the fourth embodiment of the present invention.
Figure 4B:
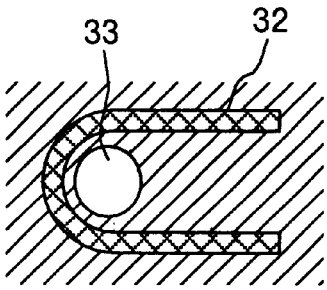

FIG. 4A shows a cross-section of a portion of a pilot nozzle 31 of the gas turbine combustor according to a fourth embodiment of this invention. FIG. 4B shows a view from the direction of an arrow E. The pilot nozzle 31 according to the fourth embodiment is characterized in that it has a U-shaped wall 32 provided in a way such that an injection port 33 is thereby surrounded to head off the pilot air blowing from upstream. The U-shaped wall 32 not simply heads off the air current from upstream of the pilot nozzle 31, it also helps whirls to arise inside the wall as combustion gas circulates in the direction of the arrow 34. Thus structured, the pilot nozzle mounted with the U-shaped wall also forms whirls of combustion gas and improves the flame stability of the diffusive flame arising at the pilot nozzle 31. As the flame stability improves, so also does fuel oil economy.

Figure 5A:
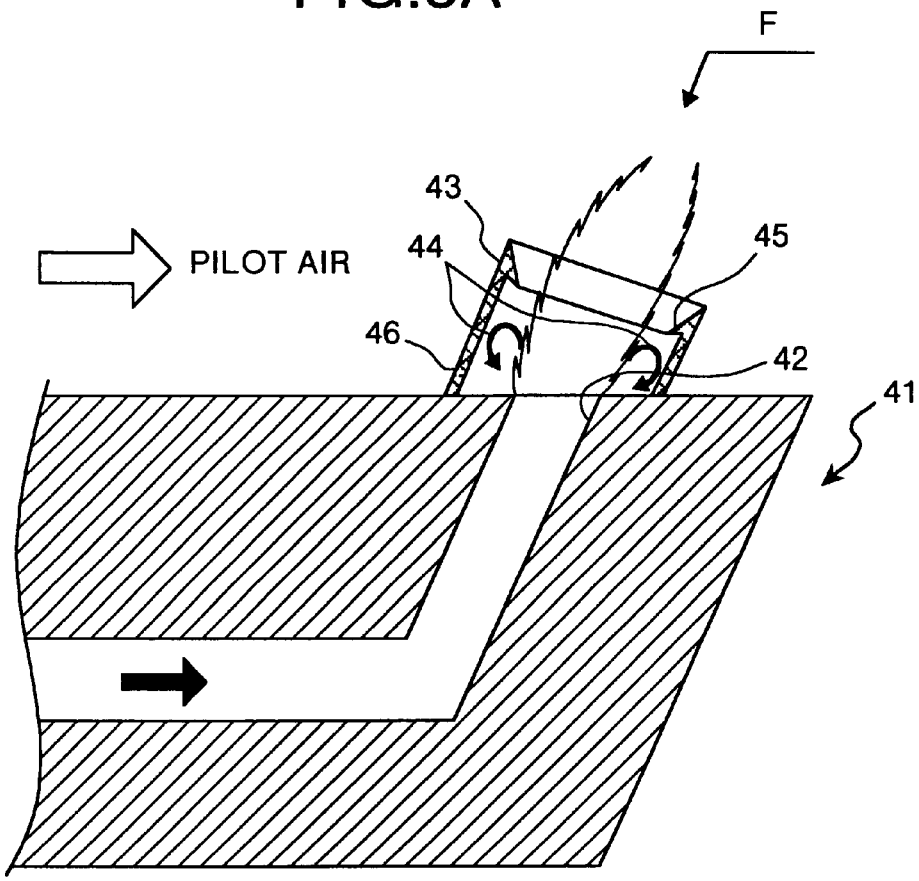
FIG. 5A and FIG. 5B are cross-sections of a portion of a pilot nozzle according to the fifth embodiment of the present invention.
Figure 5B:
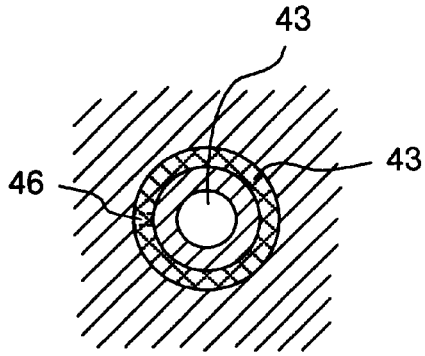

FIG. 5A shows a cross-section of a portion of a pilot nozzle 41 of the gas turbine combustor according to a fifth embodiment of this invention. FIG. 5B shows a view from the direction of an arrow F. The pilot nozzle 41 according to the fifth embodiment is characterized in that a cylindrical body 43 that protrudes so as to surround an injection port 42 is provided. This cylindrical body 43 heads off the pilot air that flows from upstream of the pilot nozzle 41 and forms whirls 44 of combustion gas inside the cylindrical body. That end of the cylindrical body 43 which is spaced afar downstream from the outlet of an injection port 42 may selectively be turned back inward in the shape 45. The purpose is to allow whirls to circulate more stably and to evade the impacts of entrained air. The cylindrical body 43 may also be installed on its flank with an air inlet 46 to supply air in a suitable amount and in a suitable direction.

In the same manner as the first through fourth embodiments of this invention, it is possible in the fifth embodiment to form whirls of combustion gas and to improve the flame stability of the diffusive flame that arises at the pilot nozzle. As the flame stability improves, so also does fuel oil economy.

Figure 6:
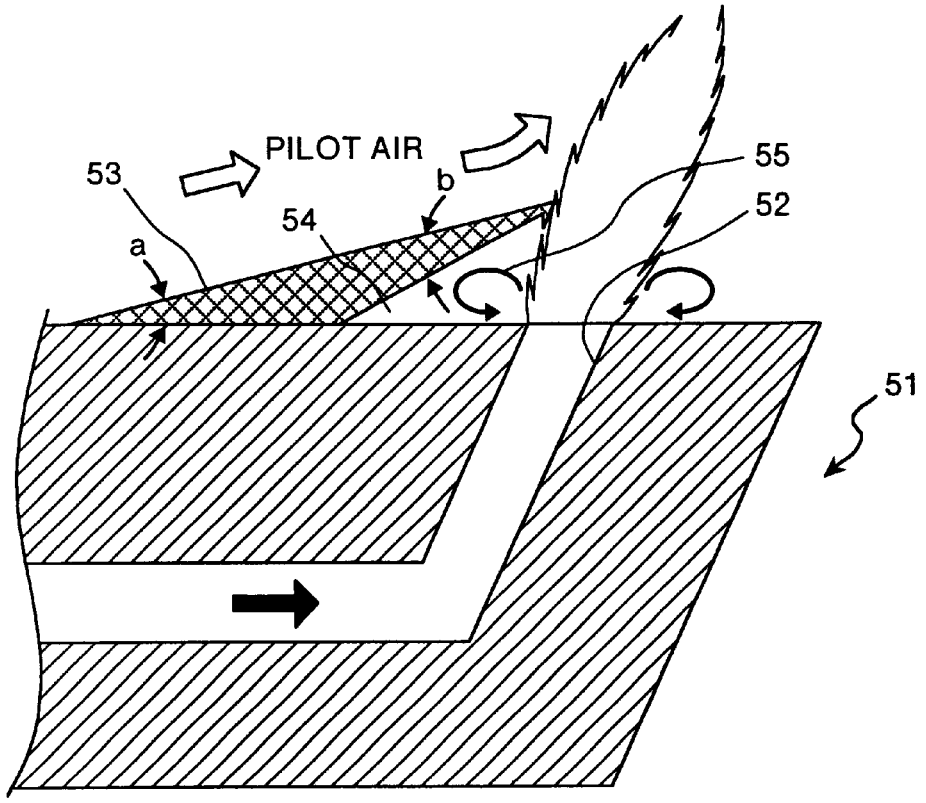
FIG. 6 is a cross-section of a portion of a pilot nozzle according to the sixth embodiment of the present invention.

FIG. 6 shows a cross-section of a portion of a pilot nozzle 51 of the gas turbine combustor according to a sixth embodiment of this invention. The pilot nozzle 51 according to the sixth embodiment is shaped so that a mixture of air and the combustion gas that accompanies fuel gas combustion does circulate. This pilot nozzle has an inclined plane 53 provided to hold off from the outlet of an injection port 52 the air flowing from upstream of the outlet of the injection port 52, relative to the flow of pilot air. At the outlet of the injection port 52, the pilot nozzle 51 has a pocket 54 provided, internal to the inclined plane 53, to allow the combustion gas to circulate.

Pilot air flows in the direction of from the rear end to the leading end of the pilot nozzle 51. When, relative to the flow of pilot air, there exists the inclined plane 53 extending from upstream of the outlet of the injection port 52 down to the outlet of the injection port 52, the air flows in the direction increasingly away from the outlet of the injection port 52. This precludes the chance of the pilot air blowing off the flame that forms at the outlet of the injection port 52.

A provision of the pocket 54 at the outlet of the injection port 52, internal to the inclined plane 53, makes a combustion gas at the injection port outlet circulate in the pocket in the direction of the arrow 55 to stabilize the flame. The inclined plane 53 may not necessarily be flat but may moderately be curved. Desirably, the angle of inclination "a" of the inclined curve 53 and the angle of formation "b" of the pocket may be suitably chosen so as to allow combustion gas to circulate efficiently.

In the same manner as the first through fifth embodiments of this invention, it is possible in the sixth embodiment to form whirls of combustion gas and to improve the flame stability of the diffusive flame that arises at the pilot nozzle. As the flame stability improves, so also does fuel oil economy.

Figure 7:
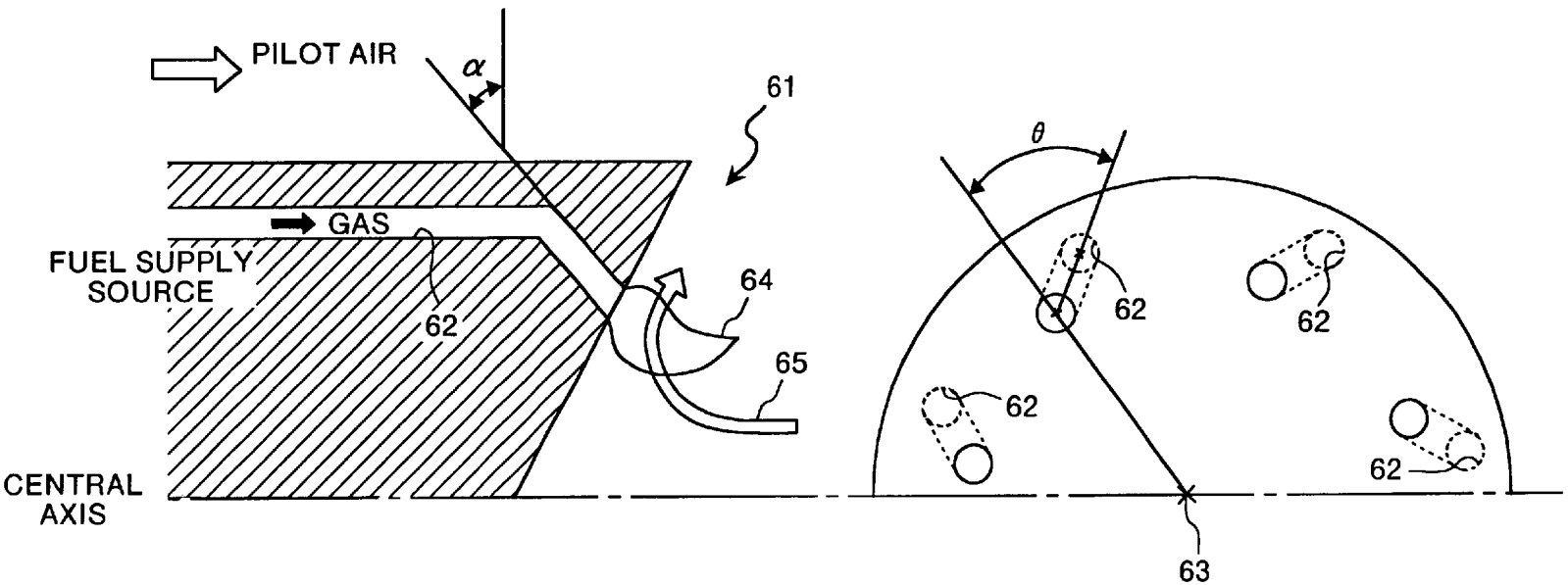
FIG. 7 is a cross-section of a portion of a pilot nozzle according to the seventh embodiment of the present invention.
Figure 8:
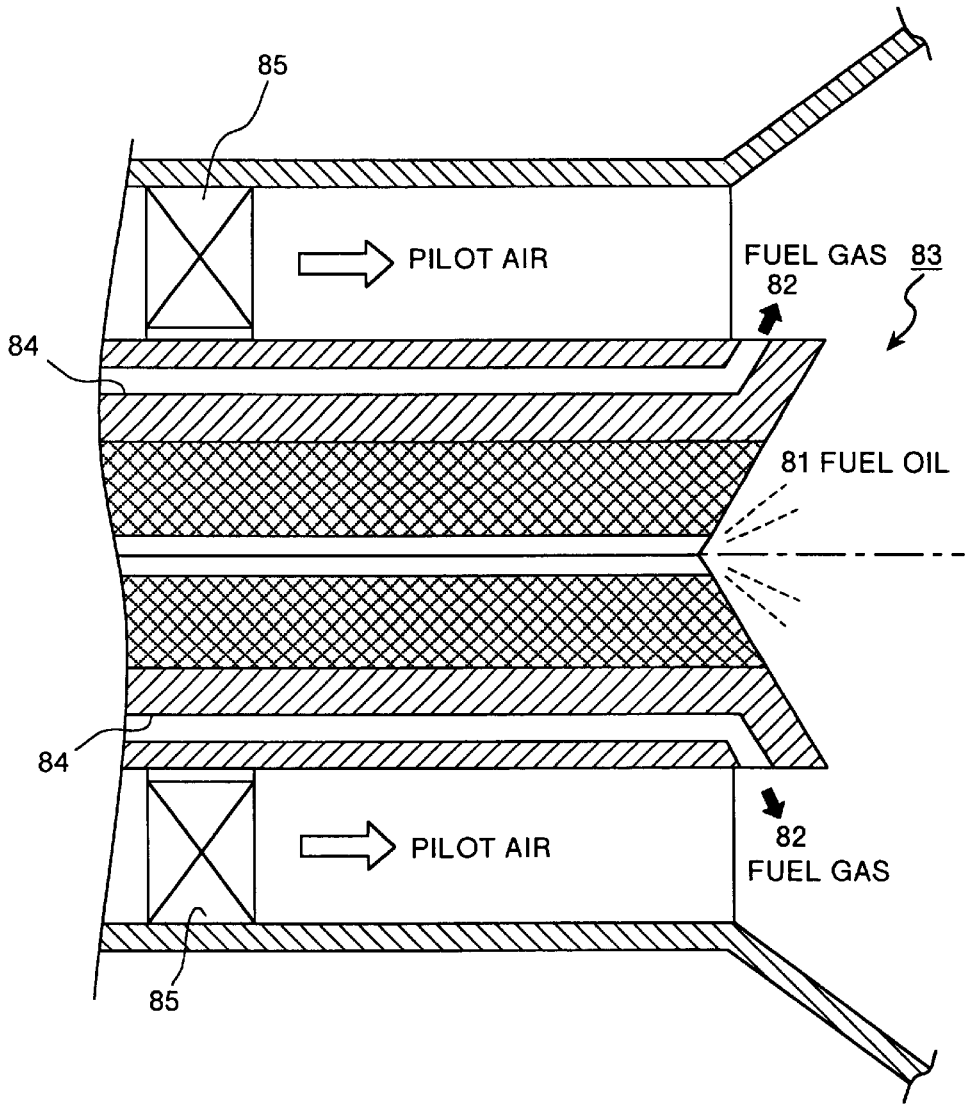
FIG. 8 is a cross-section of a pilot nozzle of a conventional gas turbine combustor.

FIG. 7 shows a cross-dimension of a portion of a pilot nozzle 61 of the gas turbine combustor according to a seventh embodiment of this invention. The pilot nozzle 61 according to the seventh embodiment is characterized in that it internally comprises a fuel-flow channel 62 that runs from a fuel gas supply source down in parallel with the axis of the pilot nozzle. The fuel-flow channel 62 is bent inward at the leading end, in the direction of the axial center of the pilot nozzle.

The fuel-flow channel 62 that runs parallel to the pilot nozzle axis 63 is bent inward at the leading end, fuel gas is accordingly injected inward in the direction of the axial center 63 of the pilot nozzle to produce a flame 64. The high temperature gas that the flame 64-induced combustion produces circulates (see 65) outward from inside the combustor. When the flame 64 is built to match the flow direction of the high temperature circulating gas, then the flame can be stabilized that much easier.

Desirably, the fuel-flow channel 62 should be directed not only inward in the direction of the pilot nozzle's axial center 63 but also outward in the direction of the pilot nozzle circumference, in order that the direction of fuel gas injection relative to the circulating gas be optimized. An inward angle $\alpha$ and outward angle $\theta$ should be set appropriately. The leading end of the fuel-flow channel 62 may not necessarily be inflected as illustrated but may well be turned inward at an optimum curvature.

In the same manner as the first through sixth embodiments of this invention, this inward directed structure of the leading end of the fuel-flow channel according to the seventh embodiment improves the flame stability of the diffusive flame arising from the pilot nozzle, the rate of improvement being substantially higher than in the case of injecting fuel gas on the circumferential side of the pilot nozzle, the side where the temperature is relatively low. This also improves flame stability and as the flame stability improves, so also does fuel oil economy.

According to the seventh embodiment, the flow channel, up to and including the leading end, is laid in parallel with the pilot nozzle axis, the flow channel is bent inward at the leading end in the direction of the axial center of the pilot nozzle. Because of this, fuel gas is injected in the direction of the axial center of the pilot nozzle to produce a pilot flame. Near this flame, a high temperature gas produced consequent upon the combustion triggered by a flame from the main nozzle circulates outwardly from inside the combustor. When, considering this, a pilot flame is produced not so much on the pilot nozzle's circumferential side where temperature is relatively low as in the direction of the circulating gas flow induced by the flame from the main nozzle, where temperature is relatively high, it becomes easy for the pilot flame to get stabilized. Desirably, as well as directing the flow channel inward perpendicularly in the direction of the axial center of the nozzle axis, the same channel may well be directed outward in the direction of the nozzle circumference so as to optimize the direction of gas injection relative to the circulating gas flowing outward.

According to the pilot nozzle of the gas turbine combustor of this invention, it becomes possible to improve the flame stability of the flame that arises at the pilot nozzle. As the flame stability improves, so also does fuel oil economy.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A pilot nozzle of a gas turbine combustor comprising:

a first structure, provided near a main nozzle of a combustor that injects fuel oil, having a flow channel for a fuel gas and an outlet for the fuel gas, the first structure diffusion-injecting the fuel gas obliquely forward through the outlet to maintain a flame and to aid ignition of the fuel oil injected from the main nozzle; and a second structure which circulates in whirls a combustion gas generated due to the combustion of the fuel gas.

2. The pilot nozzle according to claim 1, wherein the second structure includes a body disposed at a center of the flow channel and in the vicinity of the outlet that divides a flow of the fuel gas in the flow channel.

3. The pilot nozzle according to claim 1, wherein the second structure includes a cavity provided in the vicinity of the outlet on the downstream side relative to air flow and on the circumferential periphery of the pilot nozzle.

4. The pilot nozzle according to claim 1, having a central axis, wherein the flow channel being substantially parallel to the central axis and the flow channel having a portion in the vicinity of the outlet that is bent in a direction away from the central axis.

5. The pilot nozzle according to claim 1, wherein the second structure includes a cavity that surrounds the outlet.

6. The pilot nozzle according to claim 1, wherein the second structure includes a cavity obtained by widening the flows channel in the vicinity of the outlet.

7. The pilot nozzle according to claim 1, wherein the second structure includes a U-shaped protuberance surrounding the outlet, wherein the open end of the U-shaped structure points in a direction away from flow of pilot air.

8. The pilot nozzle according to claim 1, wherein the second structure includes a circular protuberance that surrounds the outlet.

9. The pilot nozzle according to claim 1, wherein the second structure includes an undercut slope provided on a downstream side relative to air flow and on the circumferential periphery of the pilot nozzle, wherein the slope rises gradually in a direction of air flow.

10. A pilot nozzle of a gas turbine combustor comprising:

a central axis;

a flow channel for a fuel gas, the flow channel being parallel to the central axis; and an outlet for injecting the fuel gas and aiding ignition of a fuel oil injected from the main nozzle, wherein a portion of the flow channel in the vicinity of the outlet is bent towards the central axis.

* * * * *